US007792444B2

(12) United States Patent
Raz et al.

(10) Patent No.: US 7,792,444 B2
(45) Date of Patent: Sep. 7, 2010

(54) METHOD FOR CALIBRATING BID CURRENT IN ELECTRO-PHOTOGRAPHIC PRINTER

(75) Inventors: Shaul Raz, Shimshit (IL); Sasi Moalem, Holon (IL); Peter Forgacs, Jerusalem (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 140 days.

(21) Appl. No.: 12/256,592

(22) Filed: Oct. 23, 2008

(65) Prior Publication Data

US 2009/0279911 A1 Nov. 12, 2009

Related U.S. Application Data

(60) Provisional application No. 61/052,426, filed on May 12, 2008.

(51) Int. Cl.
*G03G 15/10* (2006.01)

(52) U.S. Cl. ..... 399/57; 399/237

(58) Field of Classification Search ..... 399/55, 399/57, 237, 240; 324/663
See application file for complete search history.

(56) References Cited

U.S. PATENT DOCUMENTS

| | | | | |
|---|---|---|---|---|
| 5,436,706 | A | 7/1995 | Landa et al. | |
| 5,610,694 | A | 3/1997 | Lior et al. | |
| 5,737,666 | A | 4/1998 | Lior et al. | |
| 6,615,004 | B1 * | 9/2003 | Gila et al. | 399/57 |
| 7,088,932 | B2 | 8/2006 | Chou et al. | |
| 2006/0109011 | A1 * | 5/2006 | Uetake et al. | 324/663 |
| 2007/0231013 | A1 * | 10/2007 | Hasdai et al. | 399/241 |
| 2009/0097883 | A1 * | 4/2009 | Guzman et al. | 399/249 |

FOREIGN PATENT DOCUMENTS

| | | |
|---|---|---|
| WO | 2006090352 | 8/2006 |

* cited by examiner

*Primary Examiner*—Sophia S Chen

(57) ABSTRACT

A method for calibrating the BID current in an electrophotographic printer includes the steps of measuring electrode capacitance of an empty BID unit, installing the BID unit in an electrophotographic printer, comparing the measured capacitance with a calibration curve to determine the proper current for the BID unit, and adjusting the operating current of the BID unit according to the calibration curve.

20 Claims, 5 Drawing Sheets

METHOD FOR CALIBRATING BID CURRENT IN ELECTRO-PHOTOGRAPHIC PRINTER

CROSS REFERENCE TO RELATED APPLICATIONS

This Application claims the benefit of provisional patent application Ser. No. 61/052,426, filed May 12, 2008 titled "METHOD FOR CALIBRATING BID CURRENT IN ELECTRO-PHOTOGRAPHIC PRINTER" which application is incorporated by reference herein as if reproduced in full below.

BACKGROUND

The present disclosure relates to electro-photographic printing. More particularly, this disclosure relates to devices that use charged toner particles for the development of an image between conductive elements under the influence of an electric field. In many printing devices the charged particles are of a dry toner, while in others the particles are dispersed in a liquid. One example of the latter is Liquid Toner Electrophotography (LEP), in which the charged toner particles are dispersed in a carrier liquid (hereinafter "liquid toner"). The conductive elements can be part of a Binary Ink Development (BID) unit, which in LEP uses a developer cylinder with a coating of high concentration liquid toner to transfer toner particles onto a photoconductive surface. When the surface of the developer bearing the layer of liquid toner concentrate is engaged with the photoconductive surface of the cylinder, the difference in voltage between the developer cylinder and the photoconductive surface allows for selective transfer of the layer of toner particles to the photoconductive surface, thereby developing the latent image. The methods and apparatus for exposing the photoconductive surface to an image in order to create the latent image are well known to those of skill in the art.

One factor that has an effect on the operation of BID units is the current on the BID electrode(s). Methods have been developed for ink charge monitoring based upon BID current levels. However, different BID units of the same design, using the same ink solution and applying the same set of voltages, can have a different BID electrode current due to manufacturing variations, variations in BID structure, change in electrode material, variations in developer material, developer conductivity and other parameters affecting electrode current. These differences in electrode current can cause a deviation from the desired working point for the BID unit when changing BID units or installing new ones, since the working point for the BID allows correlation of the BID electrode current with the ink charge. When installing a new BID unit, even though the voltage levels remain the same or are set to default values, the BID current can change, potentially causing the ink charge monitoring system to make unnecessary or improper adjustments. This can lead to undesired print quality variations between different printer units of the same design. For example, variations in electrode current can result in undesired variation in ink thickness and ink coverage in a finished print.

BRIEF DESCRIPTION OF THE DRAWINGS

Various features and advantages of the present disclosure will be apparent from the detailed description which follows, taken in conjunction with the accompanying drawings, which together illustrate, by way of example, features of the present disclosure, and wherein.

DETAILED DESCRIPTION

Figure 1:
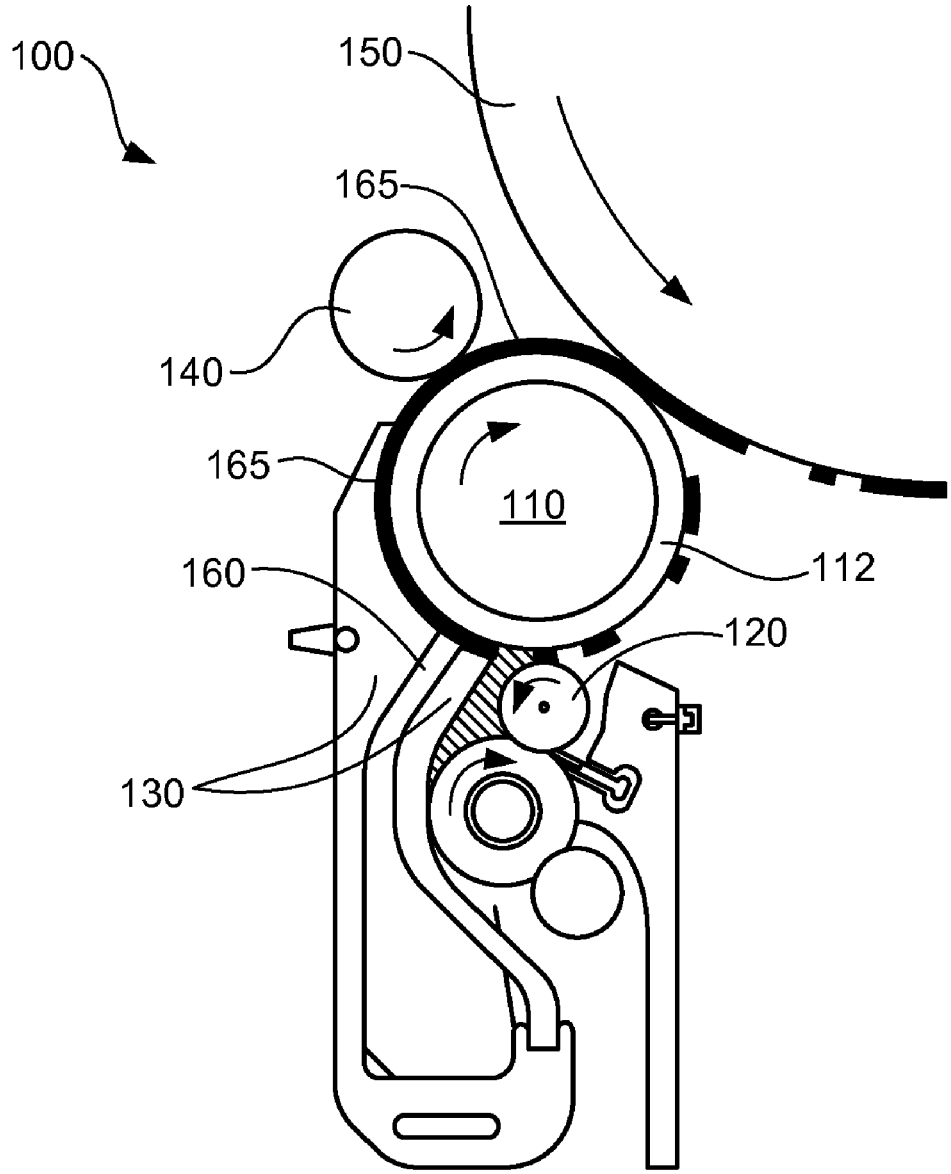
FIG. 1 is a schematic diagram of one embodiment of a print engine incorporating a BID unit.

Reference will now be made to exemplary embodiments illustrated in the drawings, and specific language will be used herein to describe the same. It will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure.

Shown in FIG. 1 is a schematic diagram of one embodiment of a Binary Ink Development (BID) unit. While the various embodiments shown and described herein are LEP devices, it is to be understood that the present disclosure also applies to other types of printing systems, such as those that use dry toner. In the embodiment of FIG. 1, the BID unit 100 includes a developer cylinder 110, one or more electrodes 130, an optional squeegee roller 140 and a cleaning cylinder 120. A photoconductor roller 150 is positioned adjacent to the developer cylinder, and can include charged and discharged areas that define an image. The developer cylinder includes a conductive layer 112 (e.g. of conductive polymer) that can be charged to a voltage that is between the voltages of the charged and discharged areas on the photoconductor surface 150. Liquid toner flows through an ink channel 160 to a space between the charged conductive layer 112 of the developer cylinder 110 and the charged electrode 130, whereby the toner particles are deposited on the conductive layer 112 of the developer cylinder 110 as a layer of concentrated toner 165. A squeegee roller 140, which can be electrified, applies both an electric field on the ink layer and pressure on the developer cylinder 110, thereby squeezing excess liquid out of the toner layer 165 on the conductive surface 112 of the developer cylinder 110, further concentrating the toner layer 165.

The developer cylinder 110 bearing the layer of liquid toner concentrate engages the photoconductor 150. The difference in potential between the conductive layer 112 of the developer cylinder 110 and the photoconductor 150 causes selective transfer of the layer of toner particles to the photoconductor, thereby developing the latent image. Depending on the choice of toner charge polarity and the use of a "write-white" or "write-black" system as known in the art, the layer of toner particles will be selectively attracted to either the charged or discharged areas of the photoconductor, and the remaining portions of the toner layer will continue to adhere to the developer cylinder 110. For cleaning, the cleaning cylinder 120 is optionally charged with a voltage potential to strip the ink from the developer cylinder and wrap it on the cleaning cylinder. Other methods of removing untransferred toner can also be used. The discharging of the ink when transferred on the cleaning cylinder initiates a current flow that can be measured on the power supply used to charge the cleaning cylinder at the specified voltage potential.

As noted above, when charging the electrodes 130 of different BID units 100 using the same ink solution and providing the same set of voltages, the electrode current can vary from unit to unit due to differences in bid structure, developer conductivity etc. Methods have been developed for monitoring ink properties by detecting the BID electrode current. In doing so, however, it has been recognized that the response curves for different BID units can be offset by some amount. The BID electrode current is typically fixed for a given BID unit design, and is usually not specifically calibrated at the time of manufacture of the BID unit and assembly of the printing system. However, given manufacturing differences between different units of the same design, the electrodes 130 will not necessarily have the same current level with the same ink and the same set of voltages, and hence will yield different ink coverage, which can affect print quality.

Additionally, methods have been developed for ink charge monitoring based upon BID current levels. However, if the BID current varies from unit to unit, this can affect the accuracy of indications of print ink properties. This can also be a concern when BID units are replaced. When replacing a BID unit, the electrode current can change even though the ink has not changed. This sort of variation can affect the ability of the system to monitor the ink properties.

Figure 2:
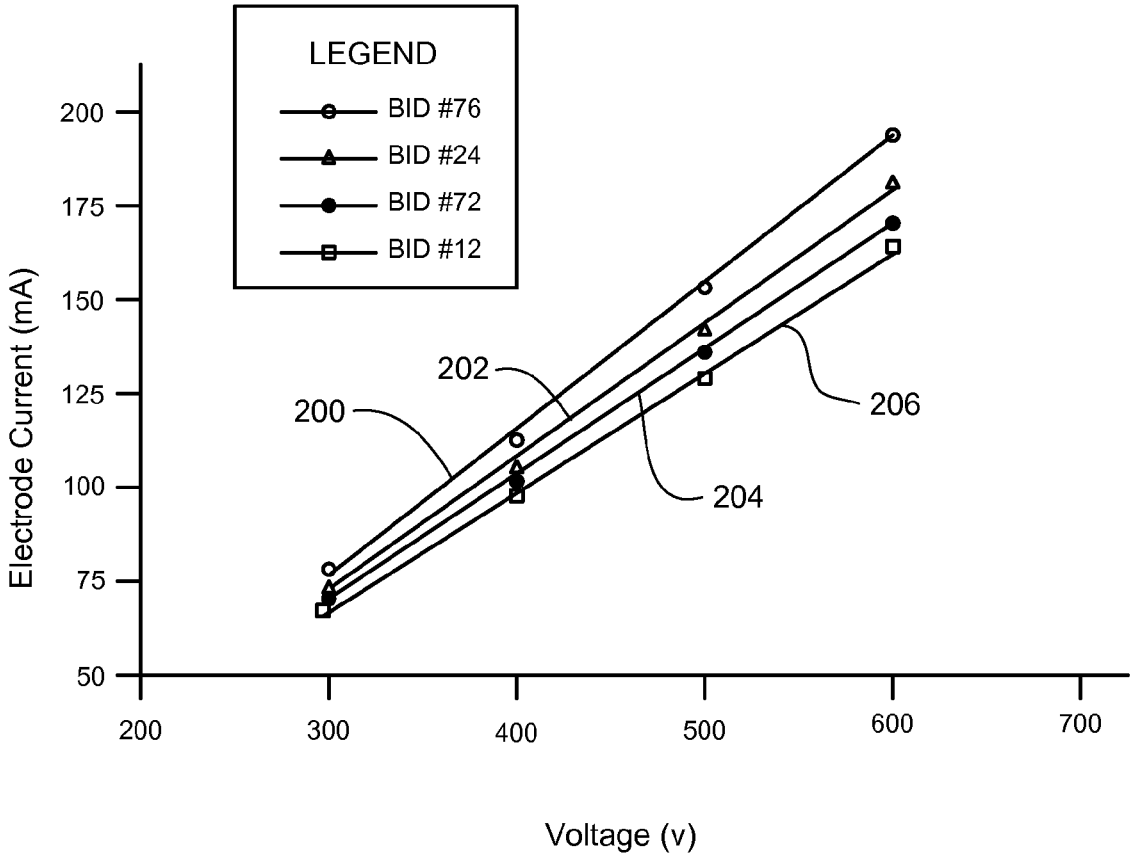
FIG. 2 is an exemplary graph of BID current versus voltage for several different BID units.

An exemplary graph of BID electrode current versus voltage for four different BID units of the same design is shown in FIG. 2. These curves are based upon actual testing of four different BID units that are labeled BID #12, #24, #72, and #76. In this figure it can be seen that each BID unit produces a curve having approximately the same slope, but the curves are shifted on the Y-axis. For example, the current versus voltage curve for BID #76 (designated by numeral 200), is higher than the same curve for BID #24 (designated 202), which is higher than the curve for BID #72 (designated 204), which is higher than the curve for BID #12 (designated 206).

To compensate for these differences in BID electrode current, a method has been developed for calibrating the BID electrode current so that this curve will substantially coincide for all units. This method generally involves first creating a calibration standard, then calibrating each BID unit when it is installed. The steps involved in one embodiment of a method for creating a calibration standard are outlined in the flowchart of FIG. 3. This embodiment involves creating a calibration curve giving the relationship between BID capacitance and BID electrode current. This curve can be used with all BID units of a given design. If the BID design changes, a new calibration curve can be created.

Figure 3:
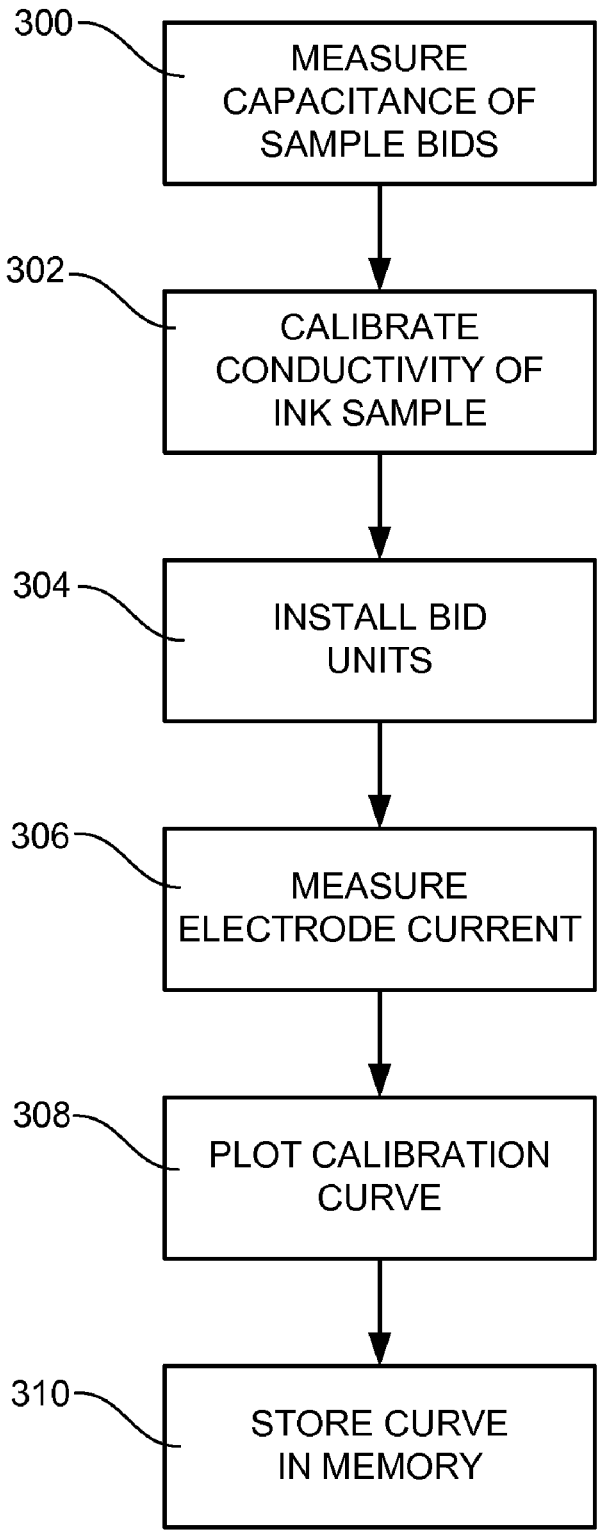
FIG. 3 is a flow chart outlining the steps in one embodiment of a method for creating a calibration curve for calibrating the BID current in an electrophotographic printer.

Referring to FIG. 3, the calibration curve is created by first measuring the capacitance of a group or sample of new, clean BID units that are empty. This is step 300. The capacitance is measured between the developer roller and the BID electrode when the bid is empty (i.e. no toner is present in the gap between the electrode and the developer roller). Measuring the BID capacitance when the BID is empty prevents the capacitance from being affected by conductive properties of the ink. It will be recognized that any ink will likely have a dielectric constant that can vary from ink to ink. With air as the dielectric, the dielectric constant remains substantially the same over time, regardless of changes in the ink. The capacitance measurement can be done with an AC signal to prevent possible inaccuracies due to the material of the developer roller. The conductive layer 112 of the developer roller 110 can include a conductive salt or other chemical substance that can migrate under a DC signal, and possibly change the results. Using an AC signal avoids this. A frequency that can be used for the AC signal is 1 KHz, though other frequencies can also be used.

In order to use the capacitance information that is obtained in step 300, a quantity of ink is then calibrated to have a specific conductivity (step 302). For example, the ink conductivity can be calibrated to 90 picomho, which is the set point for a specific ink color. (Those of skill in the art will appreciate that conductivity is the reciprocal of resistance, and is designated by the units of mho or siemens.) Other conductivity levels can also be used. The printing device is then filled with this ink, after which all of the BID units in the sample are installed in the printing device one after another (step 304). With each BID unit, a set voltage is applied, and the BID current is measured at that voltage level with the calibrated ink present (step 306). If the BID units were all truly identical, one would expect the same current for all BIDs at a given voltage. However, as discussed above, the current varies from BID to BID due to manufacturing variations, etc. Since the capacitance of each BID unit has been previously measured, the variation in current that is determined with each of the BID units installed is plotted as a function of BID capacitance to create a calibration curve (step 308). In other words, a capacitance value and current value are known for each BID, and these are plotted against each other.

Figure 4:
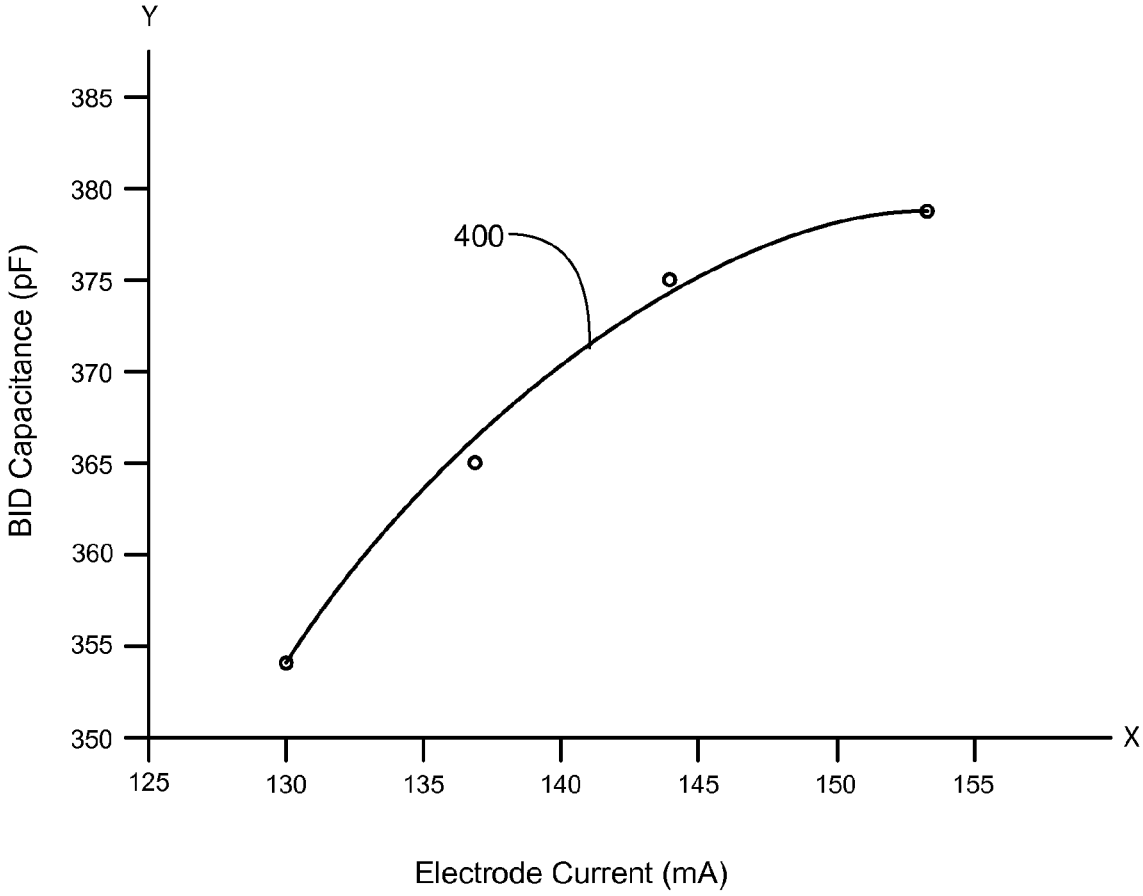
FIG. 4 is a sample calibration curve of capacitance versus BID current.

An example of a current versus capacitance curve 400 that has been prepared in this way for a sample of BID units is provided in FIG. 4. In this curve the capacitance value is plotted along the Y-axis, and the measured current is plotted on the X-axis. This curve provides a monotonic function that can be used to correlate bid capacitance with the needed electrode current. The curve 400 shown in FIG. 4 was created based upon values for current and capacitance for multiple different BID units of the same design, at the same voltage level and using the same ink solution of a known conductivity. Referring back to FIG. 3, this curve (or a look-up table providing comparable values) can be stored in memory (step 310) in each BID unit, for example in a memory chip that is part of the BID unit. Such a memory chip is routinely included in BID units to store parameters such as a serial number for the unit and an impression counter.

Figure 5:
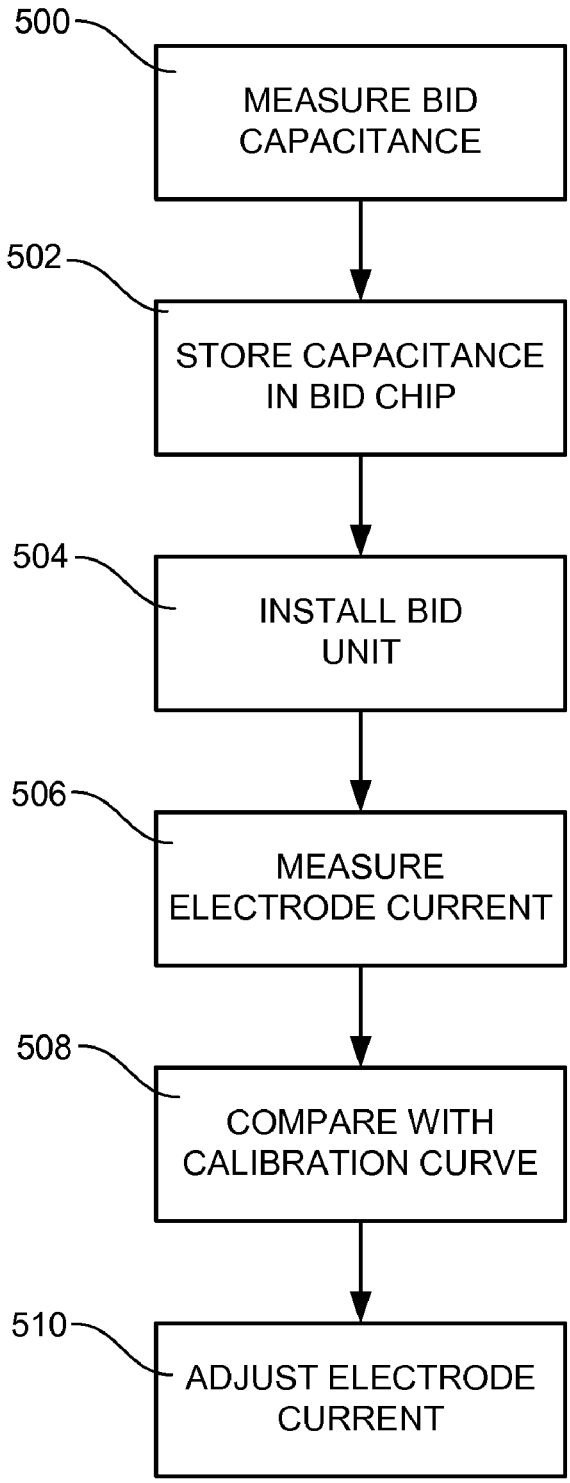
FIG. 5 is a flow chart outlining the steps in one embodiment of a method for calibrating the BID current for a single BID unit in an electrophotographic printer.

Once the calibration curve has been created and stored in memory, it is used to calibrate individual BID units as they are installed. A flowchart outlining the steps in one method for calibrating each BID unit is provided in FIG. 5. During production, the capacitance of each empty BID unit is measured (step 500) in the same manner as was done during the creation of the calibration curve. The capacitance value for the individual BID is stored in memory (step 502) in the particular BID unit, such as in the BID chip. The BID unit is then installed in its particular printer device and the device is supplied with ink (step 504).

After the BID unit is installed in the printing device, the electrode current is measured (step 506). Measurement of the current is done with ink in the electrode gap, and at the same voltage level as was used for creating the calibration standard. The software of the printing device is programmed to read the capacitance value stored in the BID unit and compare it to the calibration curve that is also stored in memory (step 508). This comparison allows the printing system to adjust the BID current to the proper level (step 510). For example, for a BID unit with capacitance Y, the proper current level X will be given with reference to the calibration curve. If the actual electrode current of that BID unit differs from this value, the system can change the current set point accordingly. More specifically, the electrode voltage of the BID unit will be varied until the electrode current substantially matches the value given by the calibration curve, and the current is then fixed at that level.

Advantageously, this approach also applies when a user replaces a BID unit. Given that different BID units will have different characteristics, recalibration of the electrode current will be desirable when a BID unit is replaced in the field. The empty capacitance of the BID unit will have been measured during production, and this value will have been stored in the BID chip, in the manner discussed above. Once the new BID unit is installed in the printer device, the software will again read the capacitance value stored in the BID chip and use that new value to update the BID current based on the same calibration curve. The electrode voltage of the new BID unit will be adjusted so that the electrode current will change by the same factor that the new and old BID units differ from the calibration curve. For example, if the current and capacitance coordinates from the calibration curve are represented as x, y, the old BID unit can have coordinates x1,y1, and the new BID unit will have coordinates x2, y2. In this case, the required change in electrode current dx will be equal to x2−x1. The electrode current is then adjusted and fixed in the manner indicated above.

This method helps ensure that the electrode current vs. ink charging curve for each BID unit will be substantially the same, regardless of the gap dimension or other structural variations. This method substantially eliminates the effects of variations in the BID electrode current vs. ink charging curve that arise from deviations in BID structure, change in electrode material, modification in developer material, developer conductivity and other parameters affecting electrode current. It also allows all BIDs to be treated as if they were a single uniform device, without the types of variations mentioned above. Additionally, when a BID unit is replaced, the current can change due to variations in the structure of the BID unit, variance in ink conductivity, or both. This method allows a user to compensate for variations in BID structure, such as electrode-developer gap, in order to allow calibration of the BID current so that ink charge properties can be accurately detected after a BID unit is replaced.

It is to be understood that the above-referenced arrangements are illustrative of the application of the principles disclosed herein. It will be apparent to those of ordinary skill in the art that numerous modifications can be made without departing from the principles and concepts of this disclosure, as set forth in the claims.

What is claimed is:

1. A method for calibrating Binary Ink Development (BID) current in an electrophotographic printer, comprising the steps of:

measuring electrode capacitance of an empty BID unit;

installing the BID unit in an electrophotographic printer;

comparing the measured capacitance with a current calibration standard to determine the proper current for the BID unit; and adjusting an operating current of the BID unit according to the calibration standard.

2. A method in accordance with claim 1, further comprising the step of storing the measured capacitance value in a memory chip associated with the BID unit.

3. A method in accordance with claim 1, further comprising the step of creating the calibration standard by measuring capacitance and electrode current of a plurality of BID units.

4. A method in accordance with claim 3, wherein the step of creating the calibration standard further comprises:

measuring the electrode capacitance of a plurality of empty BID units;

installing each of the plurality of BID units in an electrophotographic printer and filling them with ink of a known conductivity;

measuring the electrode current of each BID unit; and plotting a curve of capacitance versus electrode current for the plurality of BID units.

5. A method in accordance with claim 4, further comprising the step of adjusting the conductivity of the ink to a desired conductivity level.

6. A method in accordance with claim 1, wherein the calibration standard comprises a look-up table of coordinated capacitance and current values.

7. A method in accordance with claim 1, wherein the step of measuring electrode capacitance of the empty BID unit comprises measuring capacitance between a developer roller of the electrophotographic printer and an electrode of the BID unit.

8. A method in accordance with claim 7, wherein the step of measuring electrode capacitance of the empty BID unit comprises applying an AC signal to the developer roller and the BID electrode.

9. A method in accordance with claim 8, wherein the AC signal is at a frequency of about 1 kHz.

10. A method in accordance with claim 1, wherein the step of adjusting the operating current of the BID unit comprises varying an electrode voltage of the BID unit until an electrode current substantially matches a current value given by the calibration standard.

11. A method for replacing a Binary Ink Development (BID) unit in an electrophotographic printer, comprising the steps of:

removing an existing BID unit from the printer;

installing a new BID unit into the printer;

reading a capacitance value for the new BID unit; and adjusting an operating current of the BID unit according to a predetermined capacitance versus calibration standard.

12. A method in accordance with claim 11, wherein the step of reading a capacitance value for the new BID unit comprises reading a capacitance value stored in memory in a memory chip associated with the BID unit, the capacitance value representing capacitance measured between a developer roller of a calibration electrophotographic printer and an electrode of the BID unit with the BID unit empty.

13. A method in accordance with claim 12, wherein the capacitance is measured using an AC signal at a frequency of about 1 kHz.

14. A method in accordance with claim 11, wherein the calibration standard is selected from the group consisting of a calibration curve and a look-up table, and comprises capacitance versus calibration values for a plurality of BID units of known empty electrode capacitance, and which have had current measured at a common voltage in a calibration electrophotographic printer with an ink of known conductivity.

15. A method in accordance with claim 11, wherein the step of adjusting an operating current of the BID unit comprises varying the electrode voltage of the BID unit until an electrode current substantially matches a current value given by the calibration standard.

16. A method for producing electrophotographic printers having Binary Ink Development (BID) units, comprising the steps of:

creating a BID current calibration standard by the steps of:

measuring capacitance of a plurality of BID units when empty; and measuring electrode current of the plurality of BID units after installation in an electrophotographic printer with an ink of known conductivity;

measuring electrode capacitance of an empty production BID unit; and storing the measured capacitance value in a memory device associated with the production BID unit.

17. A method in accordance with claim 16, further comprising the steps of:

installing the production BID unit in an electrophotographic printer and tilling the production BID unit with ink;

reading the measured capacitance value from the memory device;

comparing the measured capacitance value with the current calibration standard to determine the proper current for the BID unit; and adjusting the BID current of the electrophotographic printer according to the calibration standard.

18. A method in accordance with claim 17, further comprising replacing the BID unit by the steps of:

removing the production BID unit from the printer;

installing a new BID unit into the printer;

reading an empty capacitance value for the new BID unit from a memory device associated with the new BID unit; and adjusting an operating current of the new BID unit according to the calibration standard.

19. A method in accordance with claim 16, wherein the calibration standard is selected from the group consisting of (i) a curve of capacitance versus electrode current for the plurality of BID units, and (ii) a look-up table of coordinated capacitance and current values for the plurality of BID units.

20. A method in accordance with claim 16, wherein the step of measuring electrode capacitance of the empty production BID unit comprises measuring capacitance between a developer roller of the electrophotographic printer and an electrode of the production BID unit using an AC signal at a frequency of about 1 kHz.

* * * * *

UNITED STATES PATENT AND TRADEMARK OFFICE

CERTIFICATE OF CORRECTION

PATENT NO. : 7,792,444 B2
APPLICATION NO. : 12/256592
DATED : September 7, 2010
INVENTOR(S) : Shaul Raz et al.

It is certified that error appears in the above-identified patent and that said Letters Patent is hereby corrected as shown below:

In column 7, line 6, in Claim 17, delete “tilling” and insert -- filling --, therefor.

Signed and Sealed this
First Day of March, 2011

David J. Kappos

David J. Kappos
*Director of the United States Patent and Trademark Office*